United States Patent [19]

Soong et al.

[11] 4,082,275

[45] Apr. 4, 1978

[54] SPORT RACKET

[76] Inventors: Tsai C. Soong; Jeanne F. Soong, both of 1839 Jackson Rd., Penfield, N.Y. 14526

[21] Appl. No.: 708,380

[22] Filed: Jul. 26, 1976

[51] Int. Cl.[2] ..... A63B 51/06

[52] U.S. Cl. ..... 273/73 D

[58] Field of Search ..... 273/67 R, 73 R, 73 C, 273/73 D, 96 R, 96 D, 29 A

[56] References Cited

U.S. PATENT DOCUMENTS

| | | | |
|---|---|---|---|
| 642,638 | 2/1900 | Smith | 273/96 R |
| 1,364,331 | 1/1921 | Vaile | 273/73 D |
| 2,029,790 | 2/1936 | Philipp | 273/96 R |
| 3,834,699 | 9/1974 | Pass | 273/73 D |

FOREIGN PATENT DOCUMENTS

| | | | |
|---|---|---|---|
| 543,411 | 2/1932 | Germany | 273/67 R |
| 2,143,255 | 4/1973 | Germany | 273/73 D |
| 2,255 of | 1881 | United Kingdom | 273/73 D |
| 2,717 of | 1909 | United Kingdom | 273/73 D |
| 223,151 | 10/1924 | United Kingdom | 273/73 D |

*Primary Examiner*—Richard J. Apley
*Attorney, Agent, or Firm*—Stonebraker, Shepard & Stephens

[57] ABSTRACT

A sport racket of the type having a frame, a handle, and a network of tension strands supported by the frame for hitting a ball is made to give the strand network oppositely oriented curvatures along two transverse directions to form a saddle shape so that the tension strands are curved in their strung state before engaging the ball. The frame is preferably curved in a corresponding saddle shape to support the strand network, transverse sets of strands preferably extend along the directions of curvature, and one of the directions of curvature preferably extends in the direction of the handle.

10 Claims, 4 Drawing Figures

SPORT RACKET

BACKGROUND OF THE INVENTION

The invention applies to rackets for sports such as tennis, racket ball, and squash, where conventional rackets have generally used a frame on a handle supporting a network of tension strands in a plane for hitting a ball. The invention involves recognition of the possibility for and advantages from forming the tension strand network with a double curvature in a saddle shape, and the invention aims at greater variety and enjoyment of racket sports by allowing a larger repertoire of shots and spin effects and providing a string network that is stiffer, more responsive, has a larger "sweet spot" or highly responsive area, and allows higher-velocity shots.

SUMMARY OF THE INVENTION

The invention applies to a sport racket having a frame, a handle, and a network of tension strands supported by the frame for hitting a ball and is characterized by the strand network having oppositely oriented curvatures along two transverse directions to form a saddle shape so the tension strands are curved before engaging the ball. Preferably the frame is curved to provide the curvature for the strand network, preferably transverse sets of strands are arranged respectively along opposite face sides of the strand network, and preferably one of the directions of curvature extends in the direction of the handle.

DRAWINGS

DETAILED DESCRIPTION

Figure 1:
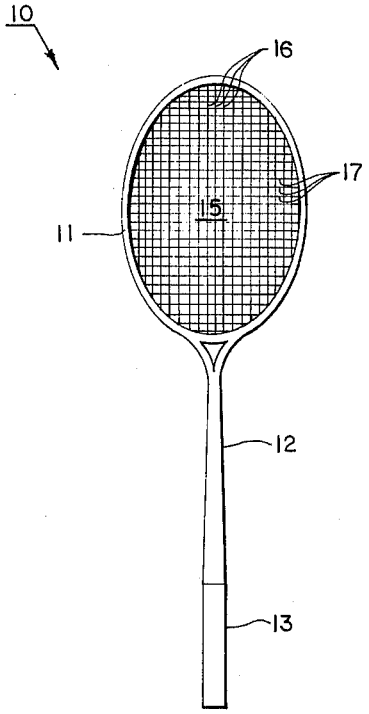
FIG. 1 is a front elevational view of one preferred embodiment of the inventive racket.

The invention applies to sport rackets for hitting a ball with a network of tension strands supported by a frame and having a handle for wielding the racket, including rackets for tennis, racket ball, squash, paddle tennis, and other racket sports. The inventive racket can also be used for new or additional sports or games where a ball is hit with a supported network of tension strands. A tennis racket was chosen for convenience of illustration in the drawings, partly because of the current popularity of tennis, but the invention is not limited to this sport.

The illustrated racket 10 has a generally oval frame 11, a handle 12, and a grip 13, but frame 11 can also be formed as circular, as a rounded rectangle, or with some other shape, and can have a wide variety of oval or elliptical shapes. Handle 12 and grip 13 can also be varied, and frame 11 and handle 12 can be formed of various materials in generally known ways. Also, experience with the inventive racket may lead to different configurations taking better advantage of the inventive curved strand network.

Racket 10 has a strand network 15 supported within frame 11 and preferably formed of generally transverse sets of strands 16 and 17. Strands 16 extend in the direction of handle 12 across the long axis of the generally oval shape of frame 11, and strands 17 are generally perpendicular to transverse to strands 16 and handle 12 to extend across the shorter axis of frame 11. Strand sets 16 and 17 can also extend at different angles relative to frame 11 and handle 12.

Figure 2:
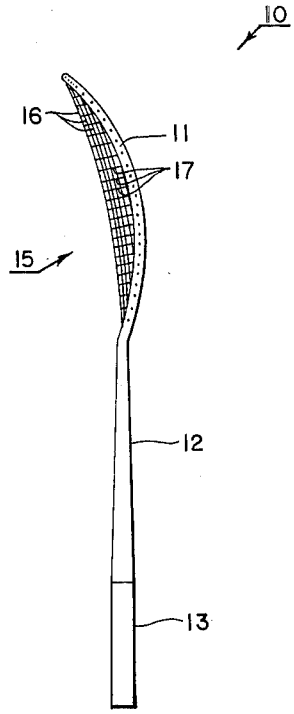
FIG. 2 is a side elevational view of the racket of FIG. 1.
Figure 3:
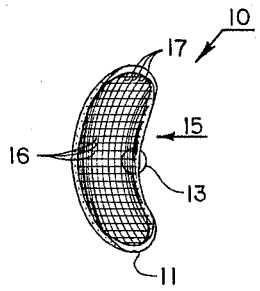
FIG. 3 is a top end view of the racket of FIG. 1 viewed along the axis of the handle.
Figure 4:
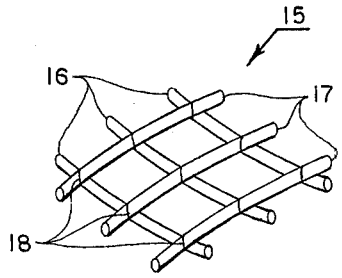
FIG. 4 is an enlarged, fragmentary view of a portion of the strand network of the racket of FIG. 1.

Frame 11 is preferably curved in at least one direction as best shown in FIGS. 2 and 3 to form strand network 15 into a saddle shape having oppositely oriented curvatures along two transverse directions. A saddle-shaped curvature for strand network 15 can also be formed by proper stringing of a frame that is relatively thick or extends for a substantial distance perpendicular to the strand network. By the frame being so thickened, the string holes can be properly located therein so as to enable stringing of the racket with the desired saddle-shaped curvature. However, a curved frame 11 is preferred for simplicity, light weight, and convenience in forming the saddle-shaped curvature for strand network 15. Frame 11 can be curved in only one direction to conform to a cylinder so that the strands tensioned within the cylindrically curved frame 11 conform to a saddle shape, or frame 11 can be curved in two transverse directions to conform to the rim of a saddle shape and also form the tension strands into a saddle-shaped curvature. The choice for curvature of frame 11 depends in part on the materials and construction methods used and the radii of curvature or amount of deviation from a plane that is desired for the saddle-shaped curvatures of strand network 15.

The opposite orientation of the transverse curvatures of saddle-shaped network 15 curve the network 15 in an arc having a radius of curvature extending around a center on one face side of the network in one of the directions of curvature, and a radius of curvature around a center on the opposite face side of the network in the opposite direction of curvature. From the point of view of a ball approaching one face side of network 15, network 15 is generally concave along one direction of curvature and generally convex along the transverse direction of curvature. The relative concave and convex curvatures are reversed in direction for the opposite face side of network 15.

To conform the strands to the saddle-shaped curvature of network 15, strands 16 extending in one direction of curvature are preferably arranged along one face side of strand network 15, and strands 17 extending in the transverse direction of curvature are preferably arranged along the opposite face side of strand network 15. With such an arrangement, strands 16 and 17 preferably bound together at their junctions by relatively thin keeper strands 18 to maintain uniformity of strand spacing in network 15. Providing the radii of curvature for strand network 15 are not too small, strand sets 16 and 17 can be alternated or interwoven to cross over and under each other as in a conventional plane strand network to eliminate or reduce the number of any keeper strands 18.

The curvature of strand network 15 in the direction of handle 12 and strands 16 along the long axis of the oval frame 11 preferably deviates farther from a plane than the curvature of network 15 in the transverse direction along the extent of strands 17. This can be merely from the longer arc along the extent of strands 16, but can also be enhanced by different radii of curvature for the transverse curvatures of saddle-shaped network 15. The network curvature in the direction of handle 12 along the extent of strands 16 is especially advantageous in offering slightly different angles of flight for balls hit at various distances along strands 16 from handle 12.

In use, the double-curved, saddle-shaped strand network 15 has several advantages over a plane strand network. One advantage is increasing the spin that can be applied to the ball by a racket stroke and network angle producing relative motion of the ball along the network. An increased ability to put spin on the ball as it is hit is known to be highly desirable in racket sports. Because of the curvature of the inventive strand network 15, the ball can readily be made to travel farther along the curved strand network than along a flat network before the ball rebounds from and clears the network in its flight away from the racket. The extra time and distance that the ball contacts the curved strand network allows a higher velocity spin to be applied to the ball than can be achieved with a plane network and a comparable racket stroke.

Another advantage is that the curved strand network 15 reduces the variation in tension of the strands as they engage a ball being hit so that the inventive strand network compared to a plane strand network is stiffer, responds faster, applies greater velocity to the ball being hit, and uses less maximum peak tension in the strands engaging the ball. When a taut strand hits a ball, it has to bend in the direction of the ball's motion relative to the strand to develop a component of force resisting the ball. In other words, the strand has to bend sufficiently to form a slope angle relative to the motion of the ball before a force component is produced to allow the strand to move the ball in the opposite direction. For a plane strand network, the ball has to sink into and deform the strand network sufficiently to elongate the strands and greatly increase their tension to develop a slope angle for the strands sufficient to produce the necessary force component for rebounding the ball away from the racket.

For the inventive curved network 15, the strands engaging the ball are already curved in strung condition and already have a portion of the strand slope required to develop and force component to rebound the ball away from the racket. This means that the ball has to penetrate only a little way into the curved strand network to develop a substantial force component in the strands whose tension increases as the ball deforms the network (the transverse strands being relaxed as this occurs). The ball thus tensions one set of the strands to relieve or take over the portion of the tension load maintained by the transverse strands and quickly develops a substantial force component for driving the ball away from the curved strand network without having to sink very deeply into the strand network. Consequently, the strands of the curved network 15 do not elongate as much as the strands of a plane network in hitting a ball, and the tension variations in the strands between maximum and minimum tension in hitting a ball is much less. The result is a stiffer, but more responsive and livelier strand network giving the user higher-velocity shots.

Another advantage is a substantial increase in the area of the "sweet spot" or most highly responsive area of a racket. For a plane strand network, strands are deformed much easier in the central portion of the network, but are very stiff and relatively nondeformable near the frame. This confines the "sweet spot" of a conventional plane strand network to a relatively small central region. In contrast, the inventive curved network is formed of strands strung to have a pre-existing curvature everywhere inside the frame, and relatively little deformation of the curved strands is required to develop a resilient force component by increasing strand tension and curvature in engaging the ball so that the strand network is relatively elastic, resilient, and highly responsive in a much larger area extending much closer to the frame than for a comparable plane network. The substantially enlarged "sweet spot" of saddle-shaped network 15 is a big advantage for the average player and can produce generally better shots and enhance the popularity of racket sports.

Another advantage of the inventive saddle-shaped strand network is its capacity for directing balls away from the network at various angles relative to different points on the network where the balls are hit. The capacity for moving balls away from the network at slightly different directions by hitting with different regions of the strand network adds another dimension in play technique and has special advantages in some circumstances. A conventional plane strand network and handle lying in a single plane provides relatively limited geometry for the user to apply to the ball, but the inventive curved network allows much greater variation in aiming shots in different directions by using different portions of the network to hit the ball.

Generally, the saddle-shaped curvature of string network 15 offers much greater versatility than a plane string network in making different shots and putting more spin on the ball as it is hit. Considerable experience with curved string network 15 may be required before all these possibilities are fully understood, but meanwhile, the invention offers a way of greatly expanding the repertoire of possible shots available for increasing the interest in already popular sports.

Those skilled in the art will appreciate the materials, construction methods, and ways of stringing and tensioning strands to form the inventive double-curved strand network with desirable curvatures for increasing the variety of possible effects.

I claim:

1. A sport racket having an open frame, a handle, and a network of two transversely oriented sets of tension strands joined to said frame to be tensioned across an open region of said frame for hitting a ball, said racket being characterized by the joining of said strand sets of said network to said frame along a curved region to provide said network with two oppositely oriented curvatures along two transverse directions forming a saddle shaped giving each opposite face side of said network both concave and convex curvatures so said tension strands are curved before engagement with said ball.

2. The racket of claim 1 wherein said frame is curved to provide said curved region for forming said curvatures for said network.

3. The racket of claim 1 wherein said transverse sets of said strands are arranged to extend along each respective one of said directions of curvature.

4. The racket of claim 3 wherein said strands extending in one of said directions of curvature are arranged along one of said face sides of said network and said strands extending in said other one of said directions of curvature are arranged along the opposite one of said face sides of said network.

5. The racket of claim 1 wherein one of said dircetions of curvature extends in the direction of said handle.

6. The racket of claim 5 wherein said transverse sets of said strands are arranged to extend along each respective one of said directions of curvature.

7. The racket of claim 6 wherein said strands extending in one of said directions of curvature are arranged along one of said face sides of said network and said strands extending in said other one of said directions of curvature are arranged along the opposite one of said face sides of said network.

8. The racket of claim 5 wherein said frame is curved to provide said curved region for forming said curvatures for said network.

9. The racket of claim 8 wherein said transverse sets of said strands extend along each respective one of said directions of curvature.

10. The racket of claim 1 wherein said frame is curved to provide said curved region for forming said curvatures for said network, and said transverse sets of said strands are arranged to extend along each respective one of said directions of curvature.

* * * * *